US012344926B2

(12) United States Patent
Task et al.

(10) Patent No.: US 12,344,926 B2
(45) Date of Patent: Jul. 1, 2025

(54) ALUMINUM-CHROMIUM DIFFUSION COATING

(71) Applicant: RAYTHEON TECHNOLOGIES CORPORATION, Farmington, CT (US)

(72) Inventors: Michael N. Task, Vernon, CT (US); Xuan Liu, Glastonbury, CT (US)

(73) Assignee: RTX CORPORATION, Farmington, CT (US)

( * ) Notice: Subject to any disclaimer, the term of this patent is extended or adjusted under 35 U.S.C. 154(b) by 602 days.

(21) Appl. No.: 17/706,050

(22) Filed: Mar. 28, 2022

(65) Prior Publication Data

US 2022/0213585 A1 Jul. 7, 2022

Related U.S. Application Data

(62) Division of application No. 15/470,949, filed on Mar. 28, 2017, now Pat. No. 11,286,550.

(51) Int. Cl.

| | |
|---|---|
| ***C23C 10/30*** | (2006.01) |
| ***C23C 10/26*** | (2006.01) |
| ***C23C 10/52*** | (2006.01) |
| ***C23C 10/54*** | (2006.01) |
| ***C23C 10/56*** | (2006.01) |
| ***C23C 10/60*** | (2006.01) |

(52) U.S. Cl.

CPC ..... *C23C 10/30* (2013.01); *C23C 10/52* (2013.01); *C23C 10/54* (2013.01); *C23C 10/56* (2013.01); *C23C 10/60* (2013.01); *C23C 10/26* (2013.01)

(58) Field of Classification Search

CPC ..... C23C 10/30; C23C 10/52; C23C 10/54; C23C 10/56; C23C 10/60; C23C 10/26

See application file for complete search history.

(56) References Cited

U.S. PATENT DOCUMENTS

| | | | | |
|---|---|---|---|---|
| 4,148,275 | A | 4/1979 | Benden et al. | |
| 4,537,927 | A | 8/1985 | Baldi | |
| 4,617,202 | A | 10/1986 | Baldi | |
| 4,694,036 | A | 9/1987 | Baldi | |
| 5,100,486 | A | 3/1992 | Krikorian et al. | |
| 5,182,078 | A | 1/1993 | Baldi | |
| 5,912,050 | A | 6/1999 | Zeigler et al. | |
| 6,273,678 | B1 | 8/2001 | Darolia | |
| 6,444,054 | B1 * | 9/2002 | Kircher | C23C 10/30 148/264 |
| 2004/0033894 | A1 | 2/2004 | Hajmrle et al. | |
| 2010/0151125 | A1 | 6/2010 | Kool et al. | |
| 2012/0060721 | A1 | 3/2012 | Kool et al. | |
| 2015/0197842 | A1 * | 7/2015 | Tang | C23C 30/00 427/256 |
| 2016/0184890 | A1 | 6/2016 | Kool et al. | |

FOREIGN PATENT DOCUMENTS

| | | |
|---|---|---|
| CN | 1213014 | 4/1999 |
| EP | 1528117 | 5/2005 |
| EP | 2796588 | 10/2014 |

OTHER PUBLICATIONS

European Search Report for European Patent Application No. 18162284.6 mailed Jun. 12, 2018.

Caron, P. and Lavigne, O. (2015). Recent studies at Onera on superalloys for single crystal turbine blades. AerospaceLab. 2011. pp. 1-14.

* cited by examiner

*Primary Examiner* — Anthony J Green

(74) *Attorney, Agent, or Firm* — Carlson, Gaskey & Olds, P.C.

(57) ABSTRACT

A process includes applying a slurry to a surface of a metallic article to produce a slurry film on the surface. The slurry is composed of a liquid carrier, chromium and aluminum, and an agent that is reactive with the chromium and aluminum to form intermediary compounds. The article and slurry film are then thermally treated at an activation temperature at which the agent reacts with the chromium and aluminum to form the intermediary compounds. The intermediary compounds deposit the chromium and aluminum on the surface. The thermal treating also diffuses the chromium and aluminum into a sub-surface region of the article such that the sub-surface region becomes enriched with chromium and aluminum.

6 Claims, 3 Drawing Sheets

ALUMINUM-CHROMIUM DIFFUSION COATING

CROSS-REFERENCE TO RELATED APPLICATION

The present disclosure is a divisional of U.S. patent application Ser. No. 15/470,949 filed Mar. 28, 2017, now issued as U.S. Pat. No. 11,286,550.

BACKGROUND

Articles that are subject to corrosion, such as gas turbine engine components, may include a coating to protect an underlying material from corrosion. Some articles have internal passages which are subject to corrosion and can be protected by such a coating.

Various techniques can be used to deposit a coating, such as "chromizing" or "aluminizing," which result in, respectively, a chromium-rich or aluminum-rich coating. Chromizing or aluminizing are commonly applied by vapor deposition processes.

SUMMARY

A process according to an example of the present disclosure includes applying a slurry to a surface of a metallic article to produce a slurry film on the surface. The slurry is composed of a liquid carrier, chromium and aluminum, and an agent that is reactive with the chromium and aluminum to form intermediary compounds. Thermal treating the article and slurry film at an activation temperature at which the agent reacts with the chromium and aluminum to form the intermediary compounds, the intermediary compounds depositing the chromium and aluminum on the surface, the thermal treating also diffusing the chromium and aluminum into a sub-surface region of the article such that the sub-surface region becomes enriched with chromium and aluminum.

In a further embodiment of any of the foregoing embodiments, the metallic article is an airfoil that includes an internal passage, and the surface is in the internal passage.

In a further embodiment of any of the foregoing embodiments, the chromium and aluminum are in the form of chromium-aluminum alloy particles.

In a further embodiment of any of the foregoing embodiments, the chromium-aluminum alloy particles have a composition, by weight, of 5% to 10% aluminum and 95% to 90% chromium.

In a further embodiment of any of the foregoing embodiments, the agent is a halide.

In a further embodiment of any of the foregoing embodiments, the halide is selected from the group consisting of ammonium chloride, chromium chloride, ammonium fluoride, and combinations thereof.

In a further embodiment of any of the foregoing embodiments, the intermediary compounds include aluminum halide and chromium halide.

In a further embodiment of any of the foregoing embodiments, the metallic article is formed of a single crystal nickel- or cobalt-based alloy.

In a further embodiment of any of the foregoing embodiments, after the thermal treating, the sub-surface region includes, by atomic percentage, 5% to 25% aluminum and 5% to 35% chromium.

In a further embodiment of any of the foregoing embodiments, after the thermal treating, the sub-surface region includes, by atomic percentage, by atomic percentage, 12% to 19% aluminum and 10% to 30% chromium, and the sub-surface region has a gamma+gamma prime phase.

In a further embodiment of any of the foregoing embodiments, the slurry further includes an additive selected from the group consisting of silicon, yttrium, hafnium, and combinations thereof.

In a further embodiment of any of the foregoing embodiments, the slurry further includes an additive selected from the group consisting of silica, mullite, alumina, or mixtures thereof. The additive reduces during the thermal treating to elemental form that diffuses into the sub-surface region.

In a further embodiment of any of the foregoing embodiments, the slurry include a liquid carrier, chromium and aluminum, and an agent that is reactive at an activation temperature with the chromium and aluminum to form intermediary compounds.

In a further embodiment of any of the foregoing embodiments, the chromium and aluminum are in the form of chromium-aluminum alloy particles.

In a further embodiment of any of the foregoing embodiments, the chromium-aluminum alloy particles have a composition, by weight, of 5% to 10% aluminum and 95% to 90% chromium.

In a further embodiment of any of the foregoing embodiments, the agent is a halide.

In a further embodiment of any of the foregoing embodiments, the halide is selected from the group consisting of ammonium chloride, chromium chloride, ammonium fluoride, and combinations thereof.

A coated article according to an example of the present disclosure includes comprising, a cobalt- or nickel-based superalloy, and a diffusion coating on the superalloy The diffusion coating has, by atomic percentage, 5% to 25% aluminum and 5% to 35% chromium. The diffusion coating has a phase field of gamma, gamma prime, or gamma+gamma prime.

In a further embodiment of any of the foregoing embodiments, the diffusion coating includes, by atomic percentage, 7% to 9% aluminum and 9% to 11% chromium.

In a further embodiment of any of the foregoing embodiments, the diffusion coating includes, by atomic percentage, 12% to 19% aluminum and 10% to 30% chromium.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1A:
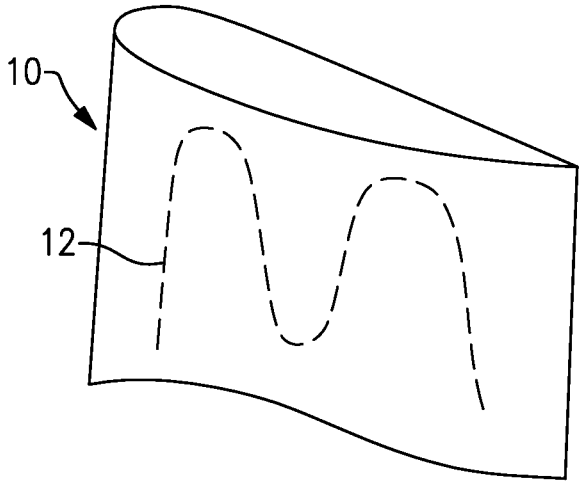
FIG. 1A illustrates an example article that has an internal passage.
Figure 1B:
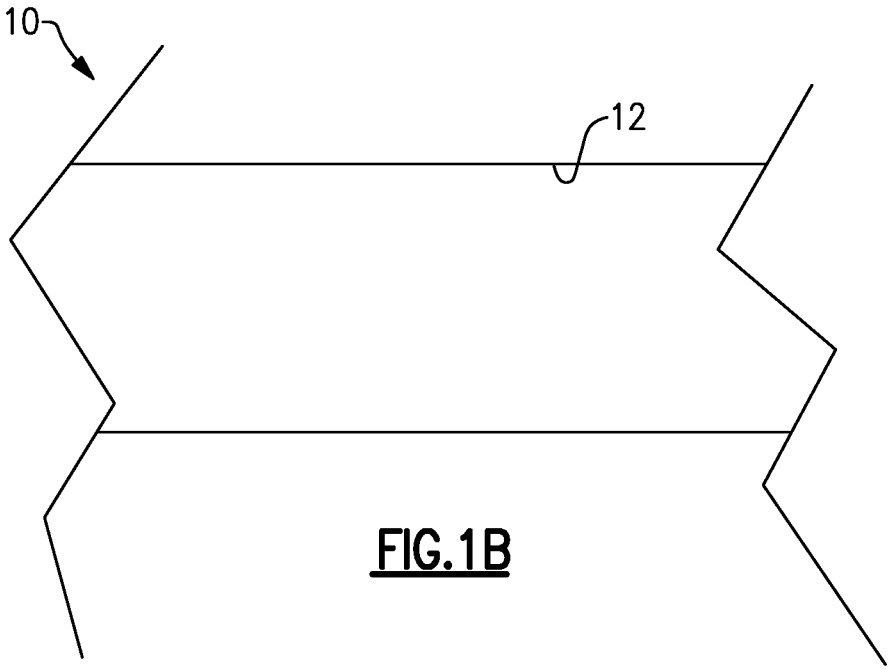
FIG. 1B illustrates a section view of the internal passage of the article.

FIG. 1A illustrates a representative portion of an example article 10 that has an internal passage 12. FIG. 1B illustrates a representative section view of the internal passage 12 of the article 10. In this example, the article 10 is an airfoil for a gas turbine engine, and the internal passage 12 may be used to convey cooling air through the airfoil. The article 10 is formed of a superalloy, such as a directionally solidified or single crystal cobalt- or nickel-based superalloy. It is to be understood, however, that this disclosure may benefit other articles or gas turbine engine components that may be exposed to corrosive environments.

In use the article 10 maybe exposed to a range of temperatures and substances from the surrounding environment. The conditions may cause hot corrosion (chemical attack at moderate temperatures by substances that deposit on the article) and high temperature oxidation of the superalloy. Chromide or aluminide diffusion coatings have been used to protect against corrosion. Chromide coatings provide good protection against hot corrosion but comparatively poor protection against high temperature oxidation. Aluminide coatings provide good protection against high temperature oxidation but comparatively poor protection against hot corrosion. In this regard, as will be described herein, the article 10 includes an aluminum-chromium diffusion coating that can be applied in a co-deposition process to facilitate protection against both hot corrosion and high temperature oxidation.

Figure 2:
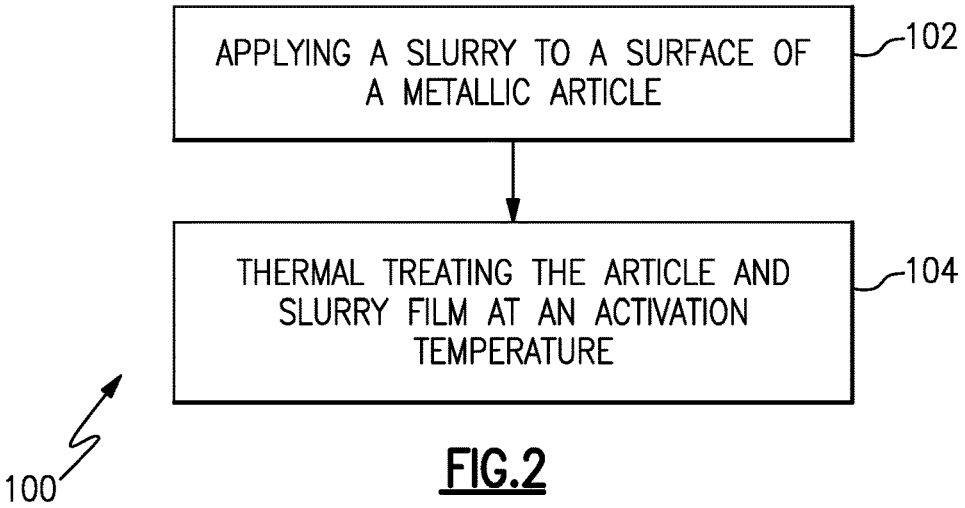
FIG. 2 illustrates a process for forming an aluminum-chromium diffusion coating on the article.
Figure 3:
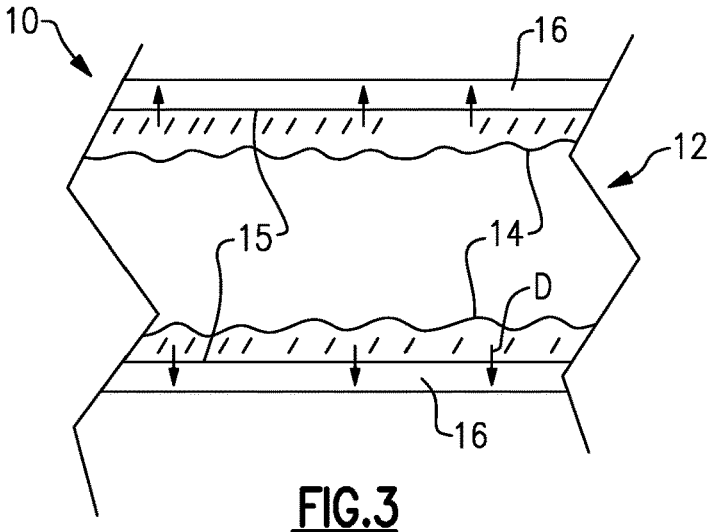
FIG. 3 illustrates the article during the process of forming the diffusion coating.

FIG. 2 illustrates a method 100 of diffusion coating the article 10, including the internal passages 12. In Step 102, a slurry is applied at least to the internal passages 12. The slurry can be applied by, for example, dipping the article 10 into the slurry, spraying the slurry onto the article 10, painting the slurry onto the article 10, flowing the slurry across the article 10 and into internal passages 12, pumping the slurry through the internal passages 12 under pressure, or by another method of application. For instance, for relatively small internal passages (e.g., micro-passages) or complex geometry internal passages, the slurry may be pumped under pressure through the internal passages 12 to ensure that the slurry reaches and coats the surfaces in the internal passages 12. Although some of the slurry may drip off, the slurry at least forms a slurry film on surfaces of the internal passages 12. As an example, FIG. 3 shows the article 10 and internal passage 12 with a slurry film 14 on surfaces 15 of the internal passage 12. In some examples, the slurry film 14 may be dried, to remove at least a portion of the liquid carrier, prior to either another iteration of depositing more of the slurry or prior to proceeding to step 104.

The slurry is composed of at least a liquid carrier, a source of chromium and aluminum (e.g., a chromium-aluminum source alloy), and an agent that is reactive with the chromium and aluminum to form intermediary compounds. As an example, the liquid carrier is a solvent, such as water, alcohol, or other solvent that is inert with regard to the constituents of the slurry. The amount of liquid carrier controls the viscosity of the slurry. The slurry contains enough liquid carrier material such that the slurry can readily flow through internal passages 12 of article 10. In one example, the amount of solids in the slurry is between about 50 and 75 percent by weight of the slurry.

The chromium and aluminum may be provided as powder particles in the slurry, in elemental form, in alloy form, or combinations thereof. In elemental form, there are powder particles that are composed exclusively of either aluminum or chromium. In alloy form, there are particles that are composed of both aluminum and chromium that may be in a homogenous mixture, such as in solid solution.

The amount of chromium and aluminum in the slurry may be selected in accordance with the amount of aluminum and chromium desired in the final aluminum-chromium diffusion coating. Due to the differing vapor pressures of the chromium and aluminum halides when Cr and Al are present in elemental form, however, the ratio of aluminum to chromium in the slurry may not necessarily result in the same ratio in the diffusion coating. For instance, aluminum in elemental form generates higher halide vapor pressures than chromium in elemental form such that aluminum has the tendency to deposit and diffuse preferentially over chromium. However, when alloyed, the activity of aluminum may be suppressed such that chromium and aluminum haldies have substantially equivalent vapor pressures and more evenly co-deposit and diffuse to form a diffusion coating enriched in both aluminum and chromium. In one example, the chromium-aluminum alloy particles have a composition, by weight, of about 5% to about 10% aluminum and about 95% to about 90% chromium. In further examples, the alloy particles have a composition, by weight, of 5.9% to 10.8% aluminum and 94.1% to 89.2% chromium.

The agent is reactive at an activation temperature with the chromium and aluminum to form intermediary compounds. For example, the agent includes a halide, such as a chloride or an fluoride. In further examples, the halide is selected from ammonium chloride, chromium chloride, ammonium fluoride, or combinations thereof.

The slurry may optionally additionally include additives to facilitate the coating process and/or alter the composition of the final diffusion coating. One example additive is a binder, such as an organic binder. Example binders may include, but are not limited to, B4 (Akron Paint and Varnis, Klucel H (a hydroxypropyl cellulose compound, by CHEMPOINT®), which is water soluble and can be used with various carrier fluids, OR aqueous colloidal silica, which could serve both as a binder and as a silicon source for the coating.

The binder serves to adhere the chromium, aluminum, and agent of the slurry film 14 to the surfaces 15 of the internal passages 12. Other example additives may include silica, mullite, alumina, mixtures thereof, or other elements or compounds that modify the composition of the final diffusion coating. For example, yttrium and/or hafnium may be used in the diffusion coating to alter oxide scale formation and oxide scale growth rate. Silicon in the form of silica, mullite, alumina, or mixtures thereof may be added in the slurry to incorporate silicon into the diffusion coating to enhance oxidation and hot corrosion resistance. The aluminum may chemically reduce the silica during the thermal treating to elemental silicon that diffuses into the sub-surface region. The silica also facilitates removal of residue after the coating process is complete. The amount of silicon in the coating can be controlled by controlling the amount and/or chemical activity of the silica in the slurry.

In Step 104 (with continued reference to FIG. 3), the article 10 with slurry film 14 is subjected to a thermal treatment at an activation temperature at which the agent reacts with the chromium and aluminum to form the intermediary compounds. For example, the intermediary compounds are chromium and aluminum halides, and potentially halides of additional elements such as hafnium, silicon, and yttrium. The intermediary compounds deposit the chromium and aluminum on the surfaces 15 of the internal passage 12. The thermal treating also diffuses the chromium and aluminum, and additive elements such as yttrium, hafnium, and silicon, into a sub-surface region 16 of the article 10, as represented at D, such that the sub-surface region 16 becomes enriched with chromium and aluminum (and additive elements if used). Once the diffusion process is completed, the sub-surface region 15, i.e., the aluminum-chromium diffusion coating, is enriched with both chromium and aluminum to enable protection against hot corrosion and high temperature oxidation.

In one example, the thermal treatment is conducted in a furnace having a continual flow of argon to produce an argon environment, in which argon is the most abundant gas, at a temperature (activation temperature) greater than 1900° F. (1038° C.), such as 1950° F. (1066° C.) to 2000° F. (1094° C.). The activation temperature may vary according to the composition of agent used but will generally be in this temperature range. The article 10 is heated for a selected amount of time, depending upon a desired thickness of the resulting aluminum-chromium diffusion coating. In some examples, the selected amount of time is between 6 and 16 hours and the final aluminum-chromium diffusion coating (the sub-surface region 16) includes, by atomic percentage, 5% to 25% aluminum and 5% to 35% chromium. In a further example, the diffusion coating includes, by atomic percentage, 7% to 9% aluminum and 9% to 11% chromium. In one further example, the diffusion coating includes, by atomic percentage, 8% aluminum and 10% chromium. In another example, to be be in the gamma+gamma prime phase field, the diffusion coating includes, by atomic percentage, 12% to 19% aluminum and 10% to 30% chromium.

Figure 5:
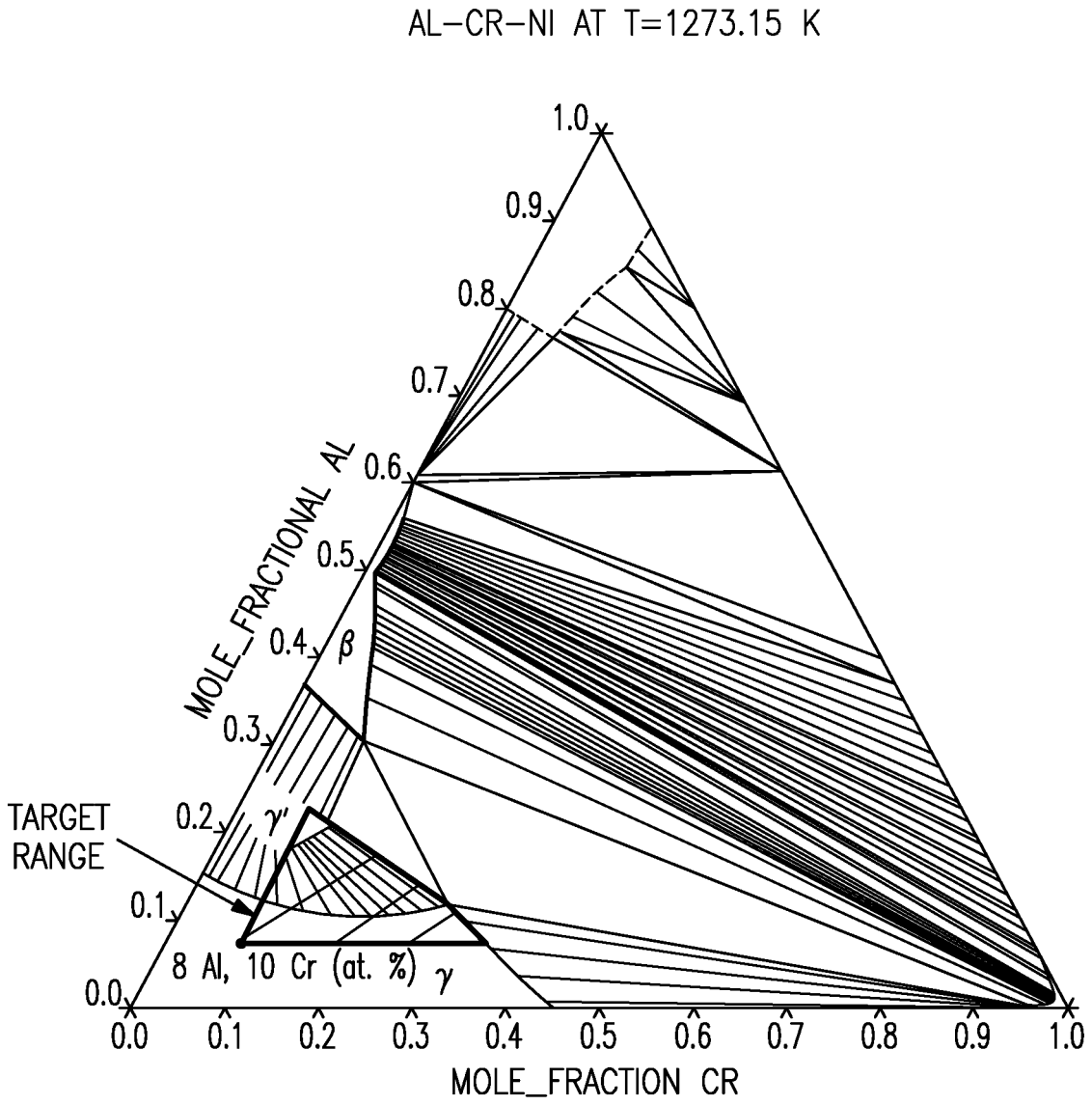
FIG. 5 illustrates an example phase diagram for an aluminum-chromium system.

In further examples, the sub-surface region 16 includes, by mole fraction, from about 0.1 to about 0.4 chromium and from about 0.08 to about 0.24 aluminum, as shown in the target range in the phase diagram of FIG. 5. The target range corresponds to the Al/Cr-rich portion of the gamma, gamma prime, and gamma+gamma prime phase fields. Notably, many other chromium or aluminide coating are beta-phase coatings in different mole fraction regimes.

Figure 4:
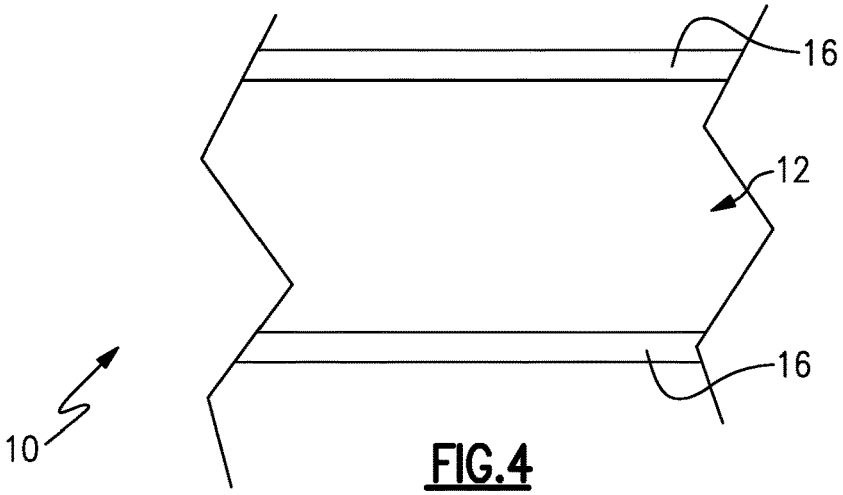
FIG. 4 illustrates the article with the final aluminum-chromium diffusion coating.

The heating and diffusion may leave a residue or crust on the surface 15 of the article 10 or internal passages 12. The article 10 may be further processed in a known manner to remove the residue, yielding an article 10 with the aluminum-chromium coating 16 having a clean surface as shown in FIG. 4.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A slurry for use in a process to coat an article, the slurry comprising:

a liquid carrier;

chromium-aluminum alloy particles that have a composition, by weight, of 5% to 10% aluminum and 95% to 90% chromium; and an agent that is reactive at an activation temperature with the chromium and aluminum to form intermediary compounds.

2. The slurry as recited in claim 1, wherein the agent is a halide.

3. The slurry as recited in claim 2, wherein the halide is selected from the group consisting of ammonium chloride, chromium chloride, ammonium fluoride, and combinations thereof.

4. The slurry as recited in claim 3, further comprising an additive that has yttrium.

5. The slurry as recited in claim 3, further comprising an additive that has hafnium.

6. The slurry as recited in claim 3, further comprising an additive selected from the group consisting of yttrium, hafnium, silica, mullite, alumina, and mixtures thereof.

* * * * *